US010777371B1

(12) United States Patent
Tsai et al.

(10) Patent No.: US 10,777,371 B1
(45) Date of Patent: Sep. 15, 2020

(54) KEY STRUCTURE

(71) Applicant: Primax Electronics Ltd., Taipei (TW)

(72) Inventors: Lei-Lung Tsai, Taipei (TW); Sheng-Fan Chang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 16/696,089

(22) Filed: Nov. 26, 2019

(30) Foreign Application Priority Data

Oct. 25, 2019 (TW) ..... 108138667 A

(51) Int. Cl.

| | |
|---|---|
| ***H01H 13/50*** | (2006.01) |
| ***H01H 13/14*** | (2006.01) |
| ***H01H 13/52*** | (2006.01) |
| ***H01H 13/64*** | (2006.01) |
| ***H01H 13/10*** | (2006.01) |

(52) U.S. Cl.
CPC ..... *H01H 13/503* (2013.01); *H01H 13/10* (2013.01); *H01H 13/14* (2013.01); *H01H 13/52* (2013.01); *H01H 13/64* (2013.01); *H01H 2205/022* (2013.01); *H01H 2221/044* (2013.01); *H01H 2225/004* (2013.01); *H01H 2225/018* (2013.01)

(58) Field of Classification Search
CPC ..... H01H 13/503; H01H 13/10; H01H 13/14; H01H 13/52; H01H 13/64; H01H 2205/022; H01H 2221/044; H01H 2225/004; H01H 2225/018; H01H 2237/004; H01H 3/125; H01H 3/12; H01H 13/705; H01H 13/7065
USPC ..... 200/5 R, 5 A, 512, 517, 341–345
See application file for complete search history.

(56) References Cited

U.S. PATENT DOCUMENTS

| | | | | |
|---|---|---|---|---|
| 8,022,322 | B2 * | 9/2011 | Yamada | H01H 3/125 200/302.2 |
| 8,569,640 | B2 * | 10/2013 | Yamada | H01H 3/125 200/302.1 |
| 8,878,086 | B2 * | 11/2014 | Chen | H01H 13/83 200/310 |
| 10,153,106 | B1 * | 12/2018 | Tsai | H01H 13/84 |
| 2008/0251370 | A1 * | 10/2008 | Aoki | H01H 13/79 200/534 |

* cited by examiner

*Primary Examiner* — Edwin A. Leon
(74) *Attorney, Agent, or Firm* — Kirton McConkie; Evan R. Witt

(57) ABSTRACT

A key structure includes a keycap, a supporting plate, a connecting element, a circuit board and an elastic element. The circuit board is disposed on the supporting plate. The circuit board includes a switch element. A first switch unit of the switch element is formed on a top surface of a first film layer of the circuit board. A second switch unit of the switch element is formed on a top surface of a second film layer of the switch element. When the keycap is depressed in response to an external force, the elastic element is subjected to deformation. Consequently, the first switch unit and the second switch unit are selectively turned on to generate a first key signal and a second key signal.

17 Claims, 9 Drawing Sheets

KEY STRUCTURE

FIELD OF THE INVENTION

The present invention relates to an input device, and more particularly to a key structure.

BACKGROUND OF THE INVENTION

In modern societies, electronic devices become indispensable parts in human lives. The electronic products are applied in many sectors, including food, clothing, housing, transportation, education and entertainment. For facilitating carrying and using electronic products, the trends of designing electronic products are toward light weightiness and slimness.

Generally, an electronic product is equipped with keys. A single key is only able to generate a single key signal. As the volume of the electronic product is gradually decreased, the number of keys is gradually reduced. Since the single key is only able to generate the single key signal, the electronic device cannot meet the requirements of diversity.

For overcoming the drawbacks of the conventional technologies, the present invention provides a key structure capable of generating two key signals. When the key structure is depressed, two travel distances corresponding to the two key signals are selectively provided.

SUMMARY OF THE INVENTION

The present invention provides a key structure capable of generating two key signals. When the key structure is depressed, two travel distances corresponding to the two key signals are selectively provided.

In accordance with an aspect of the present invention, a key structure is provided. The key structure includes a keycap, a supporting plate, a connecting element and an elastic element. The connecting element is connected with the keycap and the supporting plate. The keycap is movable upwardly or downwardly relative to the supporting plate through the connecting element. The circuit board is disposed on the supporting plate. A switch element is installed on the circuit board. The circuit board includes a first film layer, a separation layer and a second film layer. A perforation runs through the first film layer. A first switch unit of the switch element is formed on a top surface of the first film layer and arranged around the perforation. The second film layer is located under the first film layer. A second switch unit of the switch element is formed on a top surface of the second film layer. The separation layer is arranged between the first film layer and the second film layer. The separation layer has a through-hole. Moreover, two ends of the through-hole are respectively aligned with the perforation and the second switch unit. The elastic element is arranged between the keycap and the circuit board, and aligned with the switch element. The elastic element includes a conductive pressing part. The conductive pressing part includes an end surface and a raised block. The raised block is disposed on the end surface. When the keycap is depressed in response to an external force, the elastic element is subjected to deformation and the conductive pressing part is moved downwardly, and the end surface of the conductive pressing part is contacted with the first switch unit. Consequently, a first key signal is generated. When the keycap is continuously depressed in response to the external force, the raised block is penetrated through the perforation and contacted with the second switch unit. Consequently, a second key signal is generated.

In an embodiment, the elastic element further includes an elastic supporting part and a contacting part. The contacting part and the conductive pressing part are respectively located at opposite sides of the elastic supporting part. The contacting part is in contact with the keycap, and the elastic supporting part is fixed on the first film layer to provide an elastic restoring force to the keycap.

In an embodiment, the first switch unit includes a first conductive part and a second conductive part. The first conductive part and the second conductive part are respectively located beside two opposite sides of the perforation.

In an embodiment, the first conductive part and the second conductive part are semicircular-arc parts and arranged around the perforation.

In an embodiment, the second switch unit includes a third conductive part and a fourth conductive part, which are arranged beside each other.

In an embodiment, the third conductive part and the fourth conductive part are semicircular-arc parts and arranged in a staggered form.

In an embodiment, the key structure further includes a resilience element. The resilience element is arranged between the elastic element and the keycap and provides an additional traveling distance.

In an embodiment, the connecting element includes a first frame and a second frame.

In an embodiment, the elastic element is a one-piece conductive rubber structure.

In accordance with another aspect of the present invention, a key structure is provided. The key structure includes a keycap, a supporting plate, a connecting element and an elastic element. The connecting element is connected with the keycap and the supporting plate. The keycap is movable upwardly or downwardly relative to the supporting plate through the connecting element. The circuit board is disposed on the supporting plate. A switch element is installed on the circuit board. The circuit board includes a first film layer, a first separation layer, a second film layer, a second separation layer and a third film layer. A conductive layer of the switch element is formed on a bottom surface of the first film layer. The second film layer is located under the first film layer. A perforation runs through the second film layer. A first switch unit of the switch element is formed on a top surface of the second film layer and arranged around the perforation. The third film layer is located under the second film layer. A second switch unit of the switch element is formed on a top surface of the third film layer. The first separation layer is arranged between the first film layer and the second film layer. The first separation layer has a first through-hole. Moreover, two ends of the first through-hole are respectively aligned with the conductive layer and the first switch unit, the second separation layer is arranged between the second film layer and the third film layer. The second separation layer has a second through-hole. Moreover, two ends of the second through-hole are respectively aligned with the perforation and the second switch unit. The elastic element is arranged between the keycap and the circuit board, and aligned with the switch element, wherein the elastic element includes a pressing part. When the keycap is depressed in response to an external force, the elastic element is subjected to deformation and the pressing part is moved downwardly to press the first film layer, and the conductive layer is contacted with the first switch unit. Consequently, a first key signal is generated. When the keycap is continuously depressed in response to the external force, a portion of the conductive layer is penetrated through the perforation and contacted with the second switch unit. Consequently, a second key signal is generated.

In an embodiment, the elastic element further includes an elastic supporting part and a contacting part. The contacting part and the pressing part are respectively located at opposite sides of the elastic supporting part. The contacting part is in contact with the keycap. The elastic supporting part is fixed on the first film layer to provide an elastic restoring force to the keycap.

In an embodiment, the first switch unit includes a first conductive part and a second conductive part. The first conductive part and the second conductive part are respectively located beside two opposite sides of the perforation.

In an embodiment, the first conductive part and the second conductive part are semicircular-arc parts and arranged around the perforation.

In an embodiment, the second switch unit includes a third conductive part and a fourth conductive part, which are arranged beside each other.

In an embodiment, the third conductive part and the fourth conductive part are semicircular-arc parts and arranged in a staggered form.

In an embodiment, the key structure further includes a resilience element. The resilience element is arranged between the elastic element and the keycap and provides an additional traveling distance.

In an embodiment, the connecting element includes a first frame and a second frame.

According to the benefits of the present invention, a single key is capable of generating two key signals. When the key structure is depressed, the travel distances corresponding to the two key signals are selectively provided.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
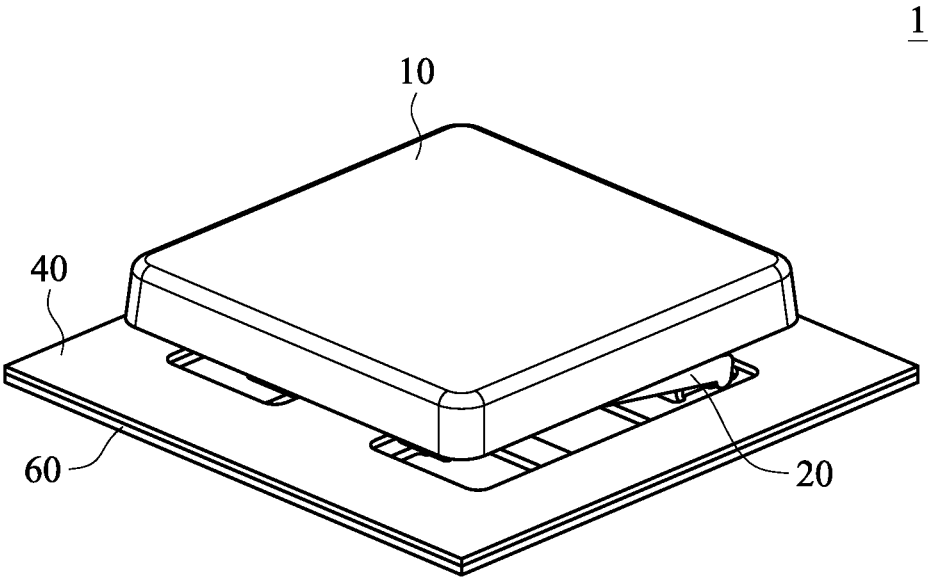
FIG. 1A is a schematic perspective view illustrating a key structure according to a first embodiment of the present invention.
Figure 1B:
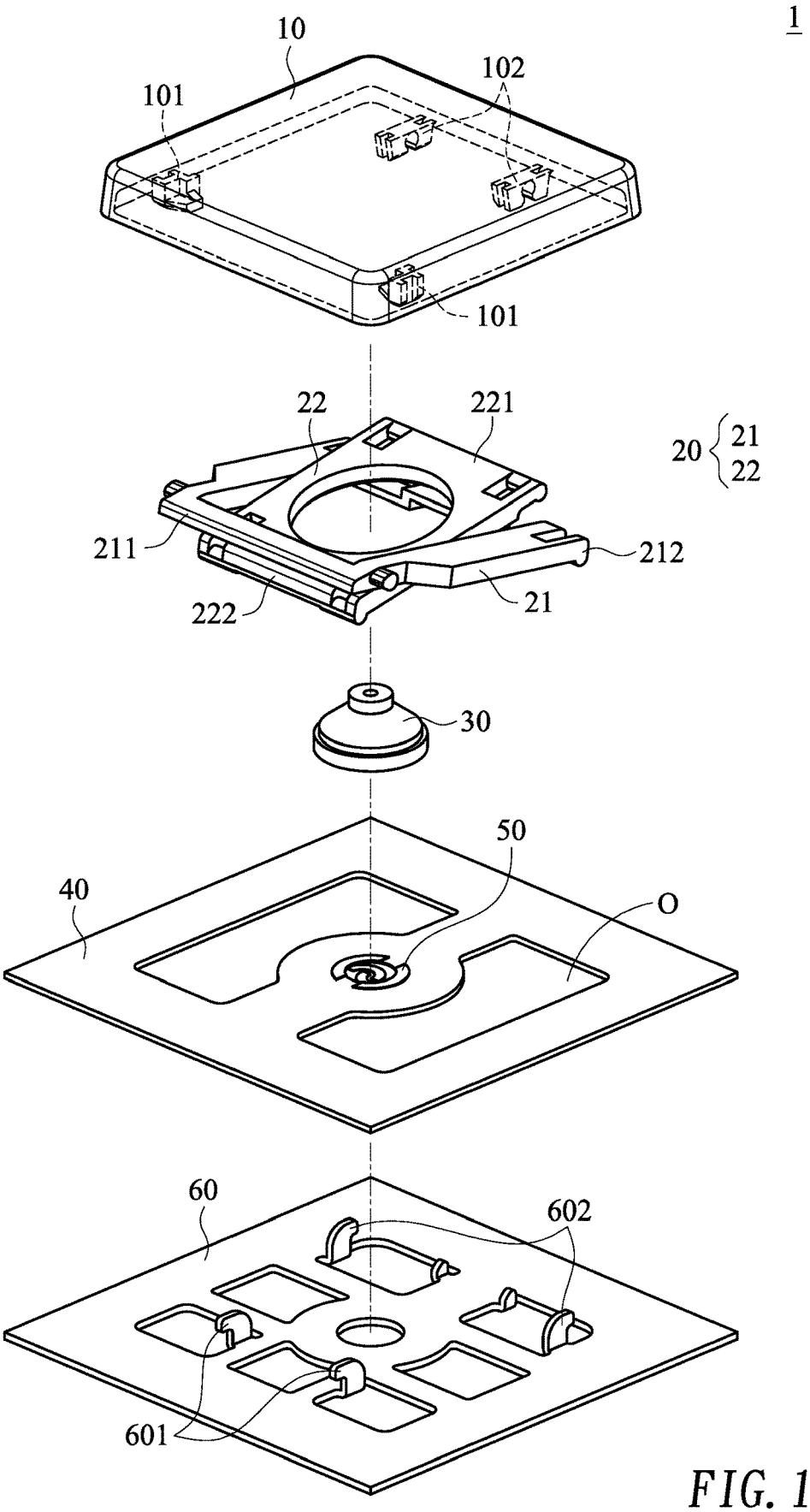
FIG. 1B is a schematic exploded view illustrating the key structure according to the first embodiment of the present invention.

Please refer to FIG. 1A and FIG. 1B. FIG. 1A is a schematic perspective view illustrating a key structure according to a first embodiment of the present invention. FIG. 1B is a schematic exploded view illustrating the key structure according to the first embodiment of the present invention. The key structure 1 comprises a keycap 10, a connecting element 20, an elastic element 30, a circuit board 40, a switch element 50 and a supporting plate 60. The switch element 50 is installed on the circuit board 40. The circuit board 40 is disposed on the supporting plate 60. The elastic element 30 is arranged between the keycap 10 and the circuit board 40 and aligned with the switch element 50. The elastic element 30 is enclosed by the connecting element 20. Moreover, the keycap 10 and the supporting plate 60 are connected with each other through the connecting element 20.

Please refer to FIG. 1B. The keycap 10 comprises first coupling parts 101 and second coupling parts 102. The first coupling parts 101 and the second coupling parts 102 are protruded from a bottom surface of the keycap 101. The connecting element 20 comprises a first frame 21 and a second frame 22. The first frame 21 has a first end 211 and a second end 212. The second frame 22 has a first end 221 and a second end 222. The supporting plate 60 comprises third couplings 601 and fourth coupling parts 602. The third couplings 601 and the fourth coupling parts 602 are penetrated through or exposed to corresponding board openings O of the circuit board 40.

For assembling the key structure 1, the first frame 21 and the second frame 22 of the connecting element 20 are pivotally coupled to each other through a rotation shaft (not shown). The first end 211 of the first frame 21 is pivotally coupled to the first coupling parts 101 of the keycap 10. The second end 212 of the first frame 21 is pivotally coupled to the fourth coupling parts 602 of the supporting plate 60. The first end 221 of the second frame 22 is pivotally coupled to the second coupling parts 102 of the keycap 10. The second end 222 of the second frame 22 is pivotally coupled to the third couplings 601 of the supporting plate 60. Consequently, the first frame 21 and the second frame 22 are rotatably connected between the keycap 10 and the supporting plate 60, and the keycap 10 is driven and guided to be ascended or descended relative to the supporting plate 60. In an embodiment, the connecting element 20 is a scissors-type connecting element. It is noted that the example of the connecting element is not restricted. In another embodiment, the connecting element includes a V-shaped linkage, an A-shaped linkage or two parallel linkages.

Figure 2:
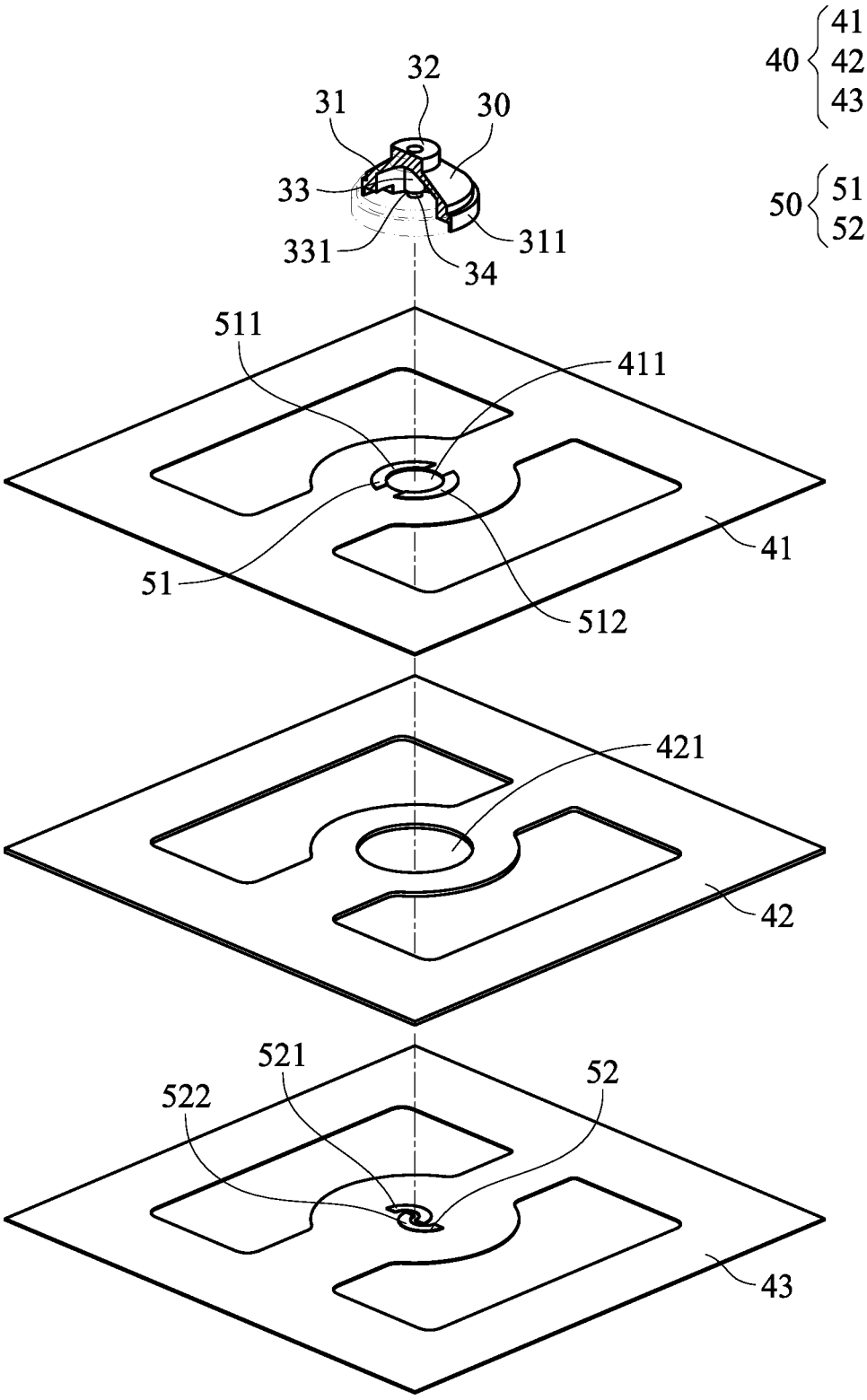
FIG. 2 is a schematic exploded view illustrating the relationship between the circuit board and the elastic element of the key structure according to the first embodiment of the present invention.

FIG. 2 is a schematic exploded view illustrating the relationship between the circuit board and the elastic element of the key structure according to the first embodiment of the present invention. As shown in FIG. 2, the elastic element 30 comprises an elastic supporting part 31, a contacting part 32 and a conductive pressing part 33. The elastic supporting part 31 has a dome shape. The conductive pressing part 33 is located at a top end of an inner space of the elastic supporting part 31. Moreover, the conductive pressing part 33 is aligned with the switch element 50. The contacting part 32 and the conductive pressing part 33 are located at opposite sides of the elastic supporting part 31, respectively. The contacting part 32 is in contact with the bottom surface of the keycap 10 (see FIG. 1B). The elastic element 30 is a one-piece conductive rubber structure. A first end of the conductive pressing part 33 away from the contacting part 32 has an end surface 331. A raised block 34 is disposed on the end surface 331 of the conductive pressing part 33. Moreover, a bottom of the elastic supporting part 31 comprises a fixing end 311.

From top to bottom, the circuit board 40 comprises a first film layer 41, a separation layer 42 and a second film layer 43 sequentially. The first film layer 41 comprises a perforation 411. The perforation 411 runs through a top surface and a bottom surface of the first film layer 41. A first switch unit 51 of the switch element 50 is formed on the top surface of the first film layer 41 and arranged around the perforation 411. The second film layer 43 is located under the first film layer 41. A second switch unit 52 of the switch element 50 is formed on a top surface of the second film layer 43. The separation layer 42 is arranged between the first film layer 41 and the second film layer 43. The separation layer 42 has a through-hole 421. The two ends of the through-hole 421 are aligned with the perforation 411 and the second switch unit 52, respectively.

The first switch unit 51 comprises a first conductive part 511 and a second conductive part 512. The second switch unit 52 comprises a third conductive part 521 and a fourth conductive part 522, which are arranged beside each other. In this embodiment, the first conductive part 511 and the second conductive part 512 are located beside two opposite sides of the perforation 411, respectively. Moreover, the first conductive part 511 and the second conductive part 512 are semicircular-arc parts and arranged around the perforation 411. The third conductive part 521 and the fourth conductive part 522 are semicircular-arc parts and arranged in a staggered form.

Figure 3:
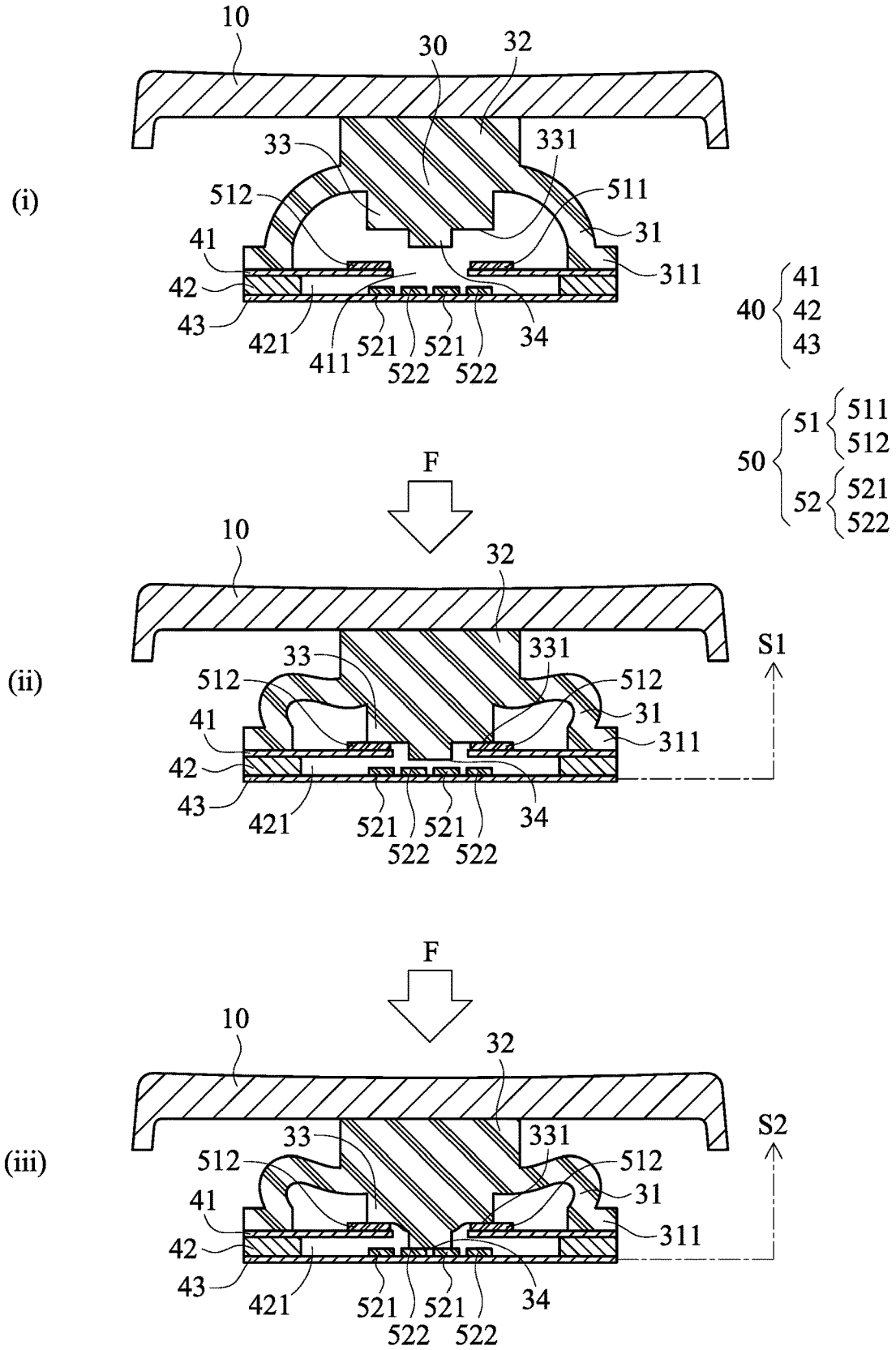
FIG. 3 schematically illustrates the operations of the key structure according to the first embodiment of the present invention.

Please refer to FIG. 3. FIG. 3 schematically illustrates the operations of the key structure according to the first embodiment of the present invention.

In the situation (i) of FIG. 3, the fixing end 311 of the elastic supporting part 31 is fixed on the top surface of the first film layer 41 in an adhering manner, and thus the elastic element 30 is fixed on the circuit board 40. The contacting part 32 is in contact with the bottom surface of the keycap 10. The contacting part 32 provides an elastic restoring force to the keycap 10 through the elastic supporting part 31. The raised block 34 of the conductive pressing part 33 is aligned with the perforation 411 and the second switch unit 52. The portion of the end surface 331 around the raised block 34 is aligned with the first switch unit 51.

In the situation (ii) of FIG. 3, an external force F is applied to the keycap 10. In response to the external force F, the keycap 10 is depressed to compress the elastic element 30. Consequently, the elastic element 30 is subjected to deformation, and the conductive pressing part 33 is moved downwardly. When the end surface 331 of the conductive pressing part 33 is contacted with the first conductive part 511 and the second conductive part 512 of the first switch unit 51, the conductive pressing part 33 is electrically connected with the first conductive part 511 and the second conductive part 512. Consequently, a first key signal S1 is generated.

In the situation (iii) of FIG. 3, the external force F is continuously applied to the keycap 10. In response to the external force F, the conductive pressing part 33 is moved downwardly and continuously. Then, the raised block 34 is penetrated through the perforation 411. When the raised block 34 is contacted with the third conductive part 521 and the fourth conductive part 522 of the second switch unit 52, the conductive pressing part 33 is electrically connected with the third conductive part 521 and the fourth conductive part 522. Consequently, a second key signal S2 is generated.

As mentioned above, the elastic element 30 is a one-piece conductive rubber structure. Consequently, the entire of the elastic element 30 is electrically conductive. It is noted that numerous modifications and alterations may be made while retaining the teachings of the invention. For example, in another embodiment, the elastic supporting part 31 and contacting part 32 are made of nonconductive elastic material. That is, only the conductive pressing part 33 is made of conductive elastic material or conductive non-elastic material.

Figure 4:
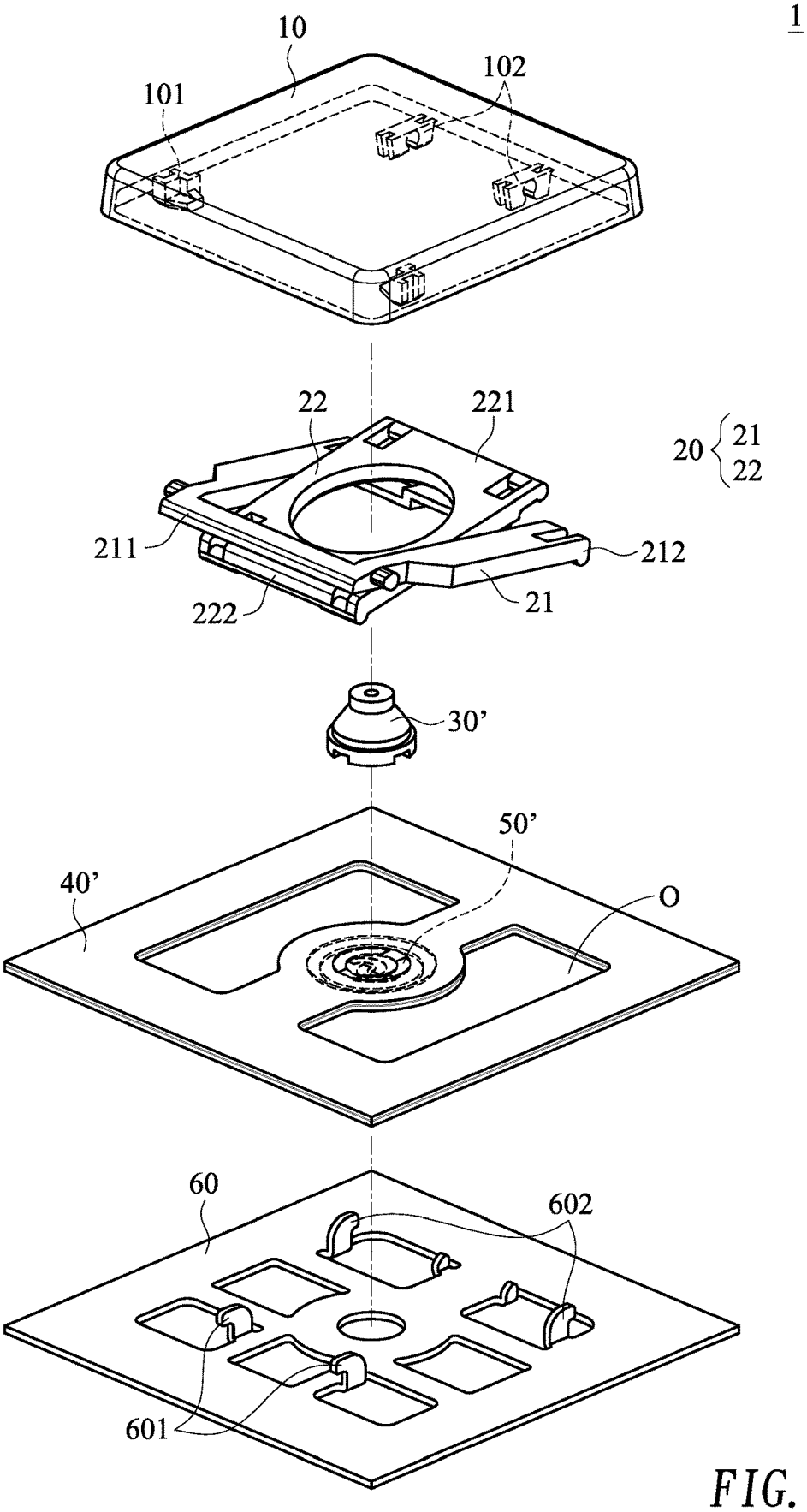
FIG. 4 is a schematic exploded view illustrating a key structure according to a second embodiment of the present invention.
Figure 5:
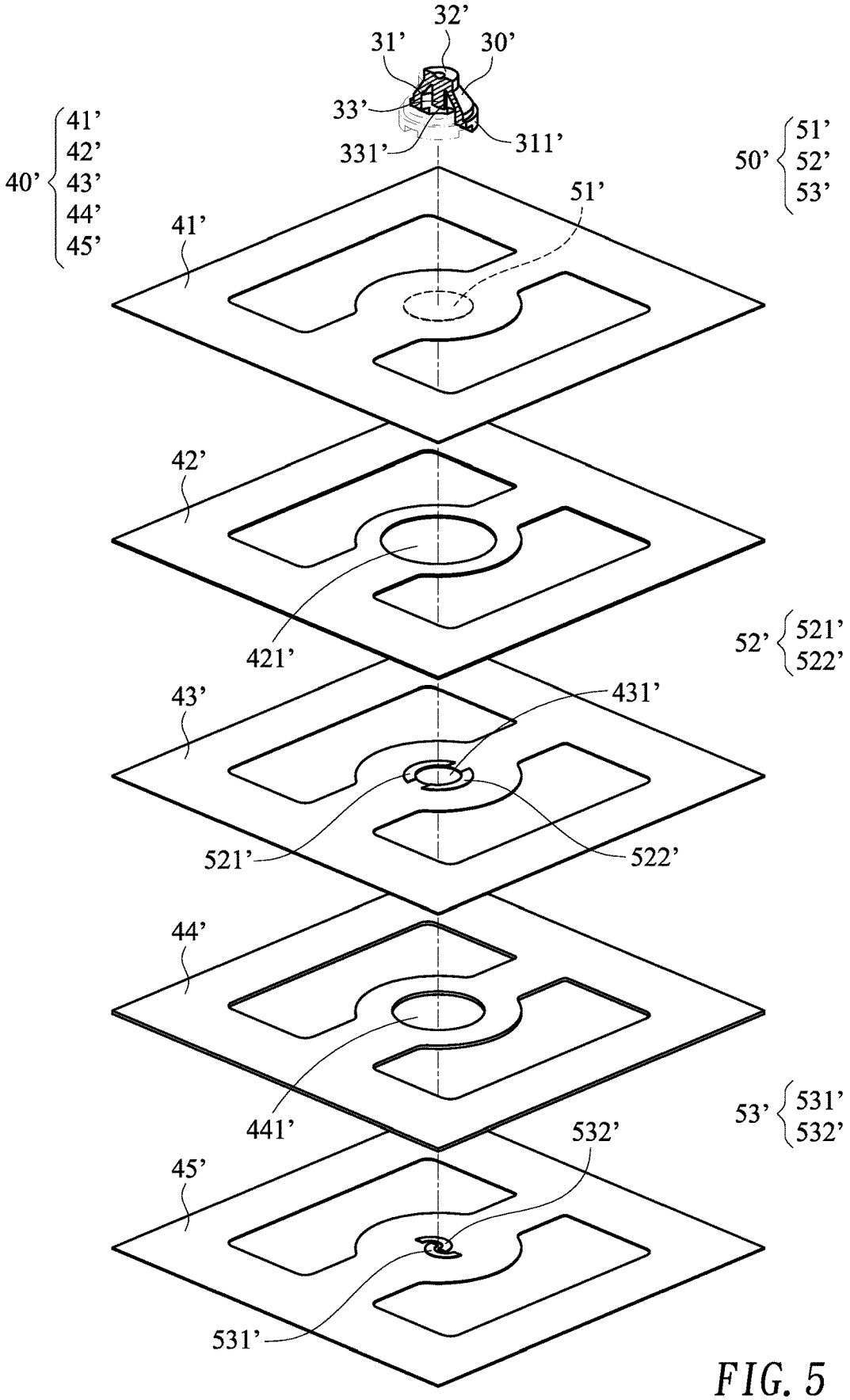
FIG. 5 is a schematic exploded view illustrating the relationship between the circuit board and the elastic element of the key structure according to the second embodiment of the present invention.

Please refer to FIGS. 4 and 5. FIG. 4 is a schematic exploded view illustrating a key structure according to a second embodiment of the present invention. FIG. 5 is a schematic exploded view illustrating the relationship between the circuit board and the elastic element of the key structure according to the second embodiment of the present invention. As shown in FIG. 4, the key structure 1 comprises a keycap 10, a connecting element 20, an elastic element 30', a circuit board 40', a switch element 50' and a supporting plate 60. The structures and functions of the keycap 10, the connecting element 20 and the supporting plate 60 are similar to those of the first embodiment, and are not redundantly described herein.

In this embodiment, the elastic element 30' is made of nonconductive elastic material such as rubber or silicone. As shown in FIG. 5, the elastic element 30' comprises an elastic supporting part 31', a contacting part 32' and a pressing part 33'. The elastic supporting part 31' has a dome shape. The pressing part 33' is located at a top end of an inner space of the elastic supporting part 31'. Moreover, the pressing part 33' is aligned with the switch element 50'. The contacting part 32' and the pressing part 33' are located at opposite sides of the elastic supporting part 31', respectively. The contacting part 32' is in contact with the bottom surface of the keycap 10 (see FIG. 4). An end of the pressing part 33' away from the contacting part 32' has an end surface 331'.

From top to bottom, the circuit board 40' comprises a first film layer 41', a first separation layer 42', a second film layer 43', a second separation layer 44' and a third film layer 45' sequentially.

A conductive layer 51' of the switch element 50' is formed on a bottom surface of the first film layer 41'. The second film layer 43' comprises a perforation 431'. The perforation 431' runs through a top surface and a bottom surface of the second film layer 43'. A first switch unit 52' of the switch element 50' is formed on the top surface of the second film layer 43' and arranged around the perforation 431'. The third film layer 45' is located under the second film layer 43'. A second switch unit 53' of the switch element 50' is formed on a top surface of the third film layer 45'. The first separation layer 42' is arranged between the first film layer 41' and the second film layer 43'. The first separation layer 42' has a first through-hole 421'. The two ends of the first through-hole 421' are aligned with the conductive layer 51' and the first switch unit 52', respectively. The second separation layer 44' is arranged between the second film layer 43' and the third film layer 45'. The second separation layer 44' has a second through-hole 441'. The two ends of the second through-hole 441' are aligned with the perforation 431' and the second switch unit 53', respectively.

The first switch unit 52' comprises a first conductive part 521' and a second conductive part 522'. The second switch unit 53' comprises a third conductive part 531' and a fourth conductive part 532', which are arranged beside each other. In this embodiment, the first conductive part 521' and the second conductive part 522' are located beside two opposite sides of the perforation 431', respectively. Moreover, the first conductive part 521' and the second conductive part 522' are semicircular-arc parts and arranged around the perforation 431'. The third conductive part 531' and the fourth conductive part 532' are semicircular-arc parts and arranged in a staggered form.

Figure 6:
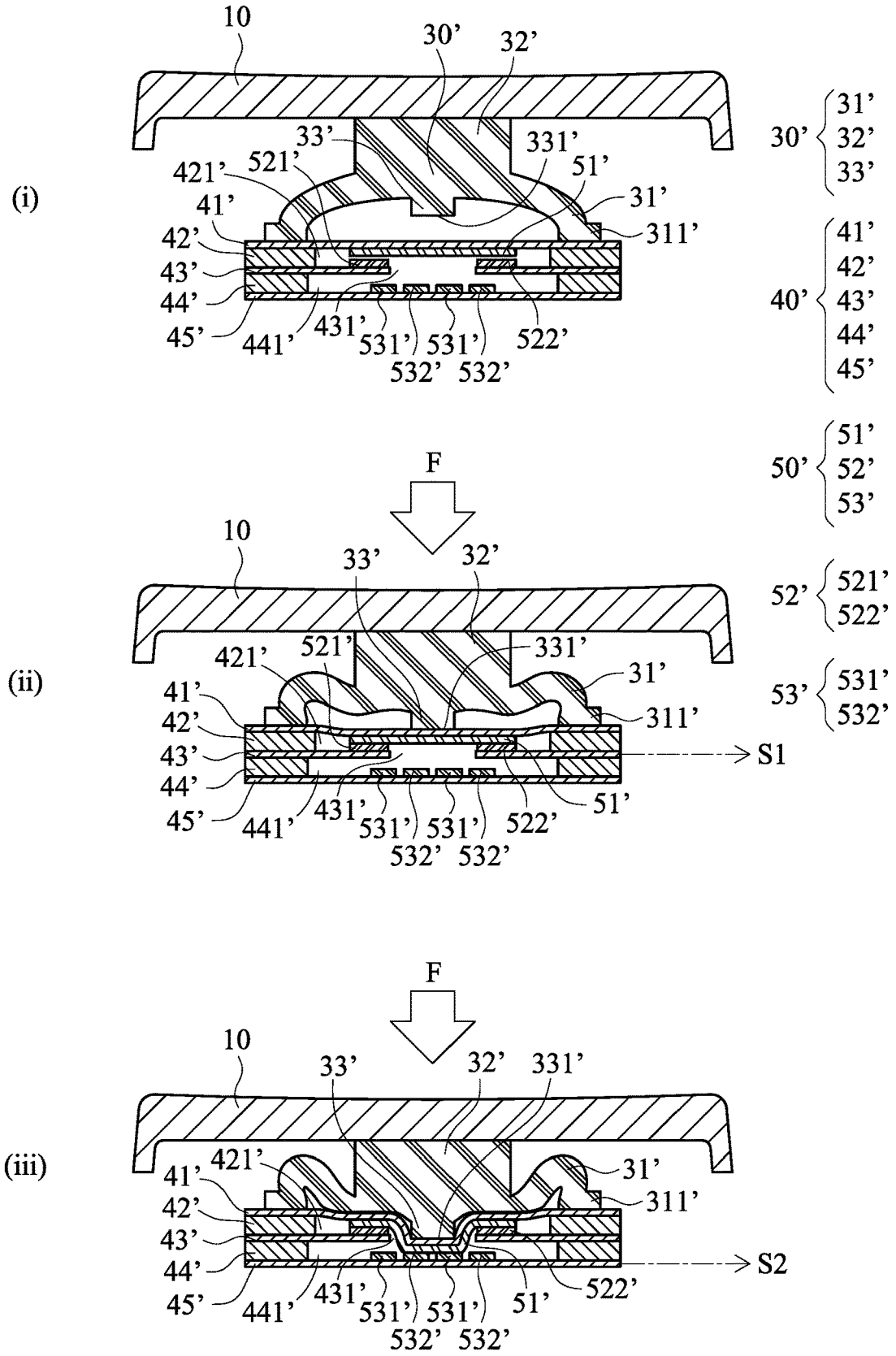
FIG. 6 schematically illustrates the operations of the key structure according to the second embodiment of the present invention.

Please refer to FIG. 6. FIG. 6 schematically illustrates the operations of the key structure according to the second embodiment of the present invention.

In the situation (i) of FIG. 6, the fixing end 311' of the elastic supporting part 31 is fixed on the top surface of the first film layer 41' in an adhering manner, and thus the elastic element 30' is fixed on the circuit board 40'. The contacting part 32' is in contact with the bottom surface of the keycap 10. The contacting part 32' provides an elastic restoring force to the keycap 10 through the elastic supporting part 31'. The end surface 331' of the pressing part 33' is aligned with the conductive layer 51' of the switch element 50'.

In the situation (ii) of FIG. 6, an external force F is applied to the keycap 10. In response to the external force F, the keycap 10 is depressed to compress the elastic element 30'. Consequently, the elastic element 30' is subjected to deformation, and the pressing part 33' is moved downwardly. When the end surface 331' of the pressing part 33' is contacted with the top surface of the first film layer 41' and the conductive layer 51' on the bottom surface of the first film layer 41' is contacted with first conductive part 521' and the second conductive part 522' of the first switch unit 52', the conductive layer 51' is electrically connected with the first conductive part 521' and the second conductive part 522'. Consequently, a first key signal S1 is generated.

In the situation (iii) of FIG. 6, the external force F is continuously applied to the keycap 10. In response to the external force F, the pressing part 33' is moved downwardly and continuously. Then, a portion of the conductive layer 51' is penetrated through the perforation 431'. When the conductive layer 51' is contacted with the third conductive part 531' and the fourth conductive part 532' of the second switch unit 53', the conductive layer 51' is electrically connected with the third conductive part 531' and the fourth conductive part 532'. Consequently, a second key signal S2 is generated.

Figure 7:
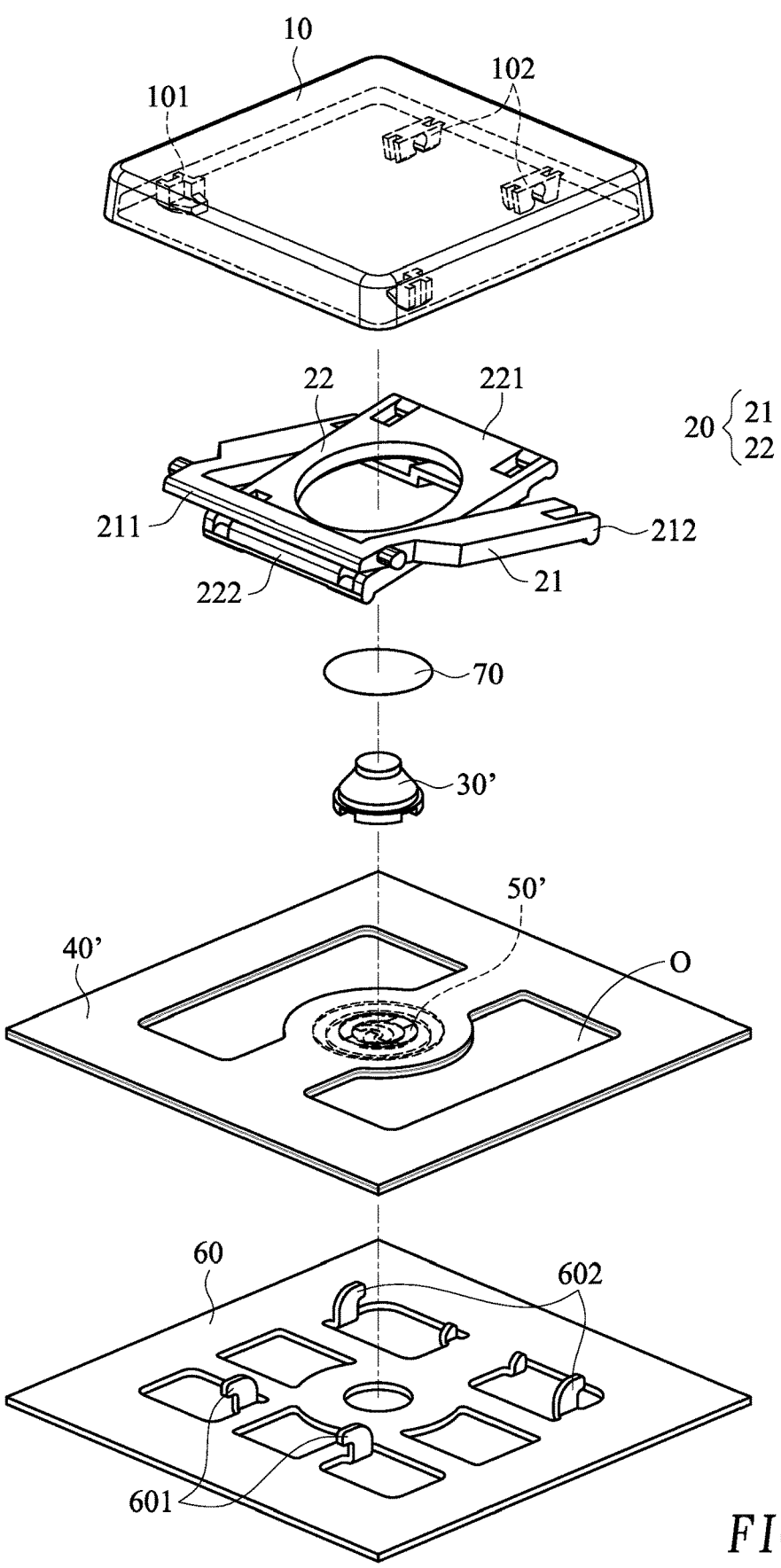
FIG. 7 is a schematic exploded view illustrating a key structure according to a third embodiment of the present invention.
Figure 8:
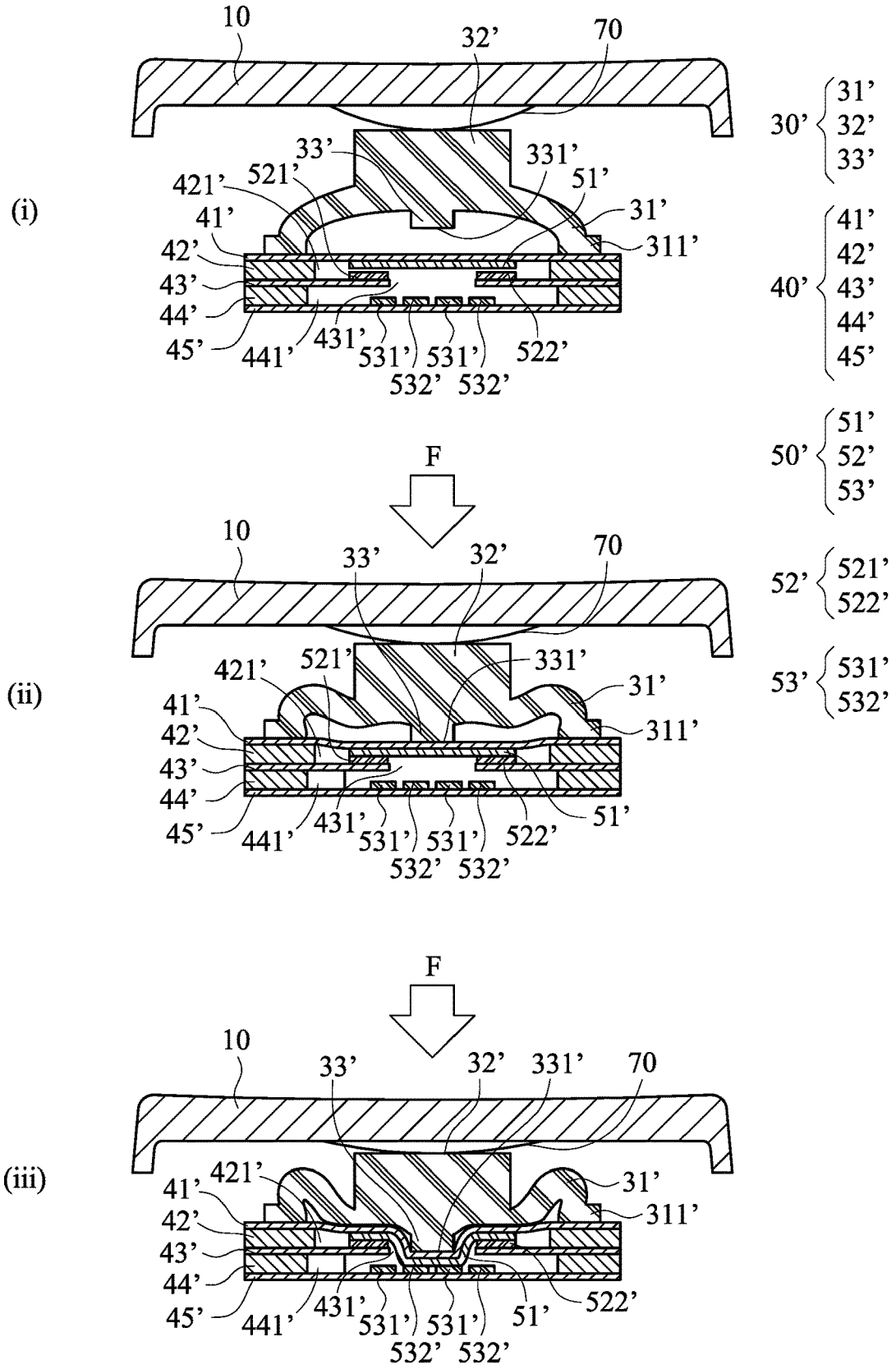
FIG. 8 schematically illustrates the operations of the key structure according to the third embodiment of the present invention.

Please refer to FIGS. 7 and 8. FIG. 7 is a schematic exploded view illustrating a key structure according to a third embodiment of the present invention. FIG. 8 schematically illustrates the operations of the key structure according to the third embodiment of the present invention. As shown in FIG. 7, the key structure 1 comprises a keycap 10, a connecting element 20, an elastic element 30', a circuit board 40', a switch element 50', a supporting plate 60 and a resilience element 70. The structures and functions of the keycap 10, the connecting element 20, the elastic element 30', the circuit board 40', the switch element 50' and the supporting plate 60 are similar to those of the second embodiment, and are not redundantly described herein. In comparison with the second embodiment, the key structure 1 of this embodiment further comprises the resilience element 70. The resilience element 70 is arranged between the elastic element 30' and the keycap 10. For example, the resilience element 70 is a metal dome.

In the situation (i) of FIG. 8, a first side of the resilience element 70 is contacted with the contacting part 32' of the elastic element 30', and a second side of the resilience element 70 is contacted with the bottom surface of the keycap 10.

In the situation (ii) of FIG. 8, an external force F is applied to the keycap 10. In response to the external force F, the elastic element 30' is subjected to deformation. Consequently, a travel distance is provided (see FIG. 6(*ii*)), and a first key signal S1 is generated (see FIG. 6(*ii*)).

In the situation (iii) of FIG. 8, the external force F is continuously applied to the keycap 10. In response to the external force F, the resilience element 70 is subjected to deformation. Consequently, another travel distance is provided (see FIG. 6(*iii*)), and a second key signal S2 is generated (see FIG. 6(*iii*)).

In this embodiment, the resilience element 70 is fixed on the elastic element 30'. It is noted that numerous modifications and alterations may be made while retaining the teachings of the invention. For example, in another embodiment, the elastic element 30' is fixed on the bottom surface of the keycap 10. Moreover, the key structure 1 of the first embodiment may be equipped with the resilience element 70 to generate the additional travel distance.

From the above descriptions, the circuit board of the key structure comprises plural film layers. The switch units are installed on the plural film layers. Consequently, a single key is capable of generating two key signals. Moreover, due to the elastic element and the resilience element, the travel distances corresponding to the two key signals are generated. In other words, the technologies of the present invention are industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a keycap;

a supporting plate;

a connecting element connected with the keycap and the supporting plate, wherein the keycap is movable upwardly or downwardly relative to the supporting plate through the connecting element;

a circuit board disposed on the supporting plate, wherein a switch element is installed on the circuit board, and the circuit board comprises a first film layer, a separation layer and a second film layer, wherein a perforation runs through the first film layer, a first switch unit of the switch element is formed on a top surface of the first film layer and arranged around the perforation, the second film layer is located under the first film layer, a second switch unit of the switch element is formed on a top surface of the second film layer, the separation layer is arranged between the first film layer and the second film layer, the separation layer has a through-hole, and two ends of the through-hole are respectively aligned with the perforation and the second switch unit; and an elastic element arranged between the keycap and the circuit board, and aligned with the switch element, wherein the elastic element comprises a conductive pressing part, wherein the conductive pressing part comprises an end surface and a raised block, and the raised block is disposed on the end surface, wherein when the keycap is depressed in response to an external force, the elastic element is subjected to deformation and the conductive pressing part is moved downwardly, and the end surface of the conductive pressing part is contacted with the first switch unit, so that a first key signal is generated, wherein when the keycap is continuously depressed in response to the external force, the raised block is penetrated through the perforation and contacted with the second switch unit, so that a second key signal is generated.

2. The key structure according to claim 1, wherein the elastic element further comprises an elastic supporting part and a contacting part, wherein the contacting part and the conductive pressing part are respectively located at opposite sides of the elastic supporting part, wherein the contacting part is in contact with the keycap, and the elastic supporting part is fixed on the first film layer to provide an elastic restoring force to the keycap.

3. The key structure according to claim 1, wherein the first switch unit comprises a first conductive part and a second conductive part, wherein the first conductive part and the second conductive part are respectively located beside two opposite sides of the perforation.

4. The key structure according to claim 3, wherein the first conductive part and the second conductive part are semicircular-arc parts and arranged around the perforation.

5. The key structure according to claim 1, wherein the second switch unit comprises a third conductive part and a fourth conductive part, which are arranged beside each other.

6. The key structure according to claim 5, wherein the third conductive part and the fourth conductive part are semicircular-arc parts and arranged in a staggered form.

7. The key structure according to claim 1, wherein the key structure further comprises a resilience element, wherein the resilience element is arranged between the elastic element and the keycap and provides an additional traveling distance.

8. The key structure according to claim 1, wherein the connecting element comprises a first frame and a second frame.

9. The key structure according to claim 1, wherein the elastic element is a one-piece conductive rubber structure.

10. A key structure, comprising:

a keycap;

a supporting plate;

a connecting element connected with the keycap and the supporting plate, wherein the keycap is movable upwardly or downwardly relative to the supporting plate through the connecting element;

a circuit board disposed on the supporting plate, wherein a switch element is installed on the circuit board, and the circuit board comprises a first film layer, a first separation layer, a second film layer, a second separation layer and a third film layer, wherein a conductive layer of the switch element is formed on a bottom surface of the first film layer, the second film layer is located under the first film layer, a perforation runs through the second film layer, a first switch unit of the switch element is formed on a top surface of the second film layer and arranged around the perforation, the third film layer is located under the second film layer, a second switch unit of the switch element is formed on a top surface of the third film layer, the first separation layer is arranged between the first film layer and the second film layer, the first separation layer has a first through-hole, two ends of the first through-hole are respectively aligned with the conductive layer and the first switch unit, the second separation layer is arranged between the second film layer and the third film layer, the second separation layer has a second through-hole, and two ends of the second through-hole are respectively aligned with the perforation and the second switch unit;

an elastic element arranged between the keycap and the circuit board, and aligned with the switch element, wherein the elastic element comprises a pressing part, wherein when the keycap is depressed in response to an external force, the elastic element is subjected to deformation and the pressing part is moved downwardly to press the first film layer, and the conductive layer is contacted with the first switch unit, so that a first key signal is generated, wherein when the keycap is continuously depressed in response to the external force, a portion of the conductive layer is penetrated through the perforation and contacted with the second switch unit, so that a second key signal is generated.

11. The key structure according to claim 10, wherein the elastic element further comprises an elastic supporting part and a contacting part, wherein the contacting part and the pressing part are respectively located at opposite sides of the elastic supporting part, wherein the contacting part is in contact with the keycap, and the elastic supporting part is fixed on the first film layer to provide an elastic restoring force to the keycap.

12. The key structure according to claim 10, wherein the first switch unit comprises a first conductive part and a second conductive part, wherein the first conductive part and the second conductive part are respectively located beside two opposite sides of the perforation.

13. The key structure according to claim 12, wherein the first conductive part and the second conductive part are semicircular-arc parts and arranged around the perforation.

14. The key structure according to claim 10, wherein the second switch unit comprises a third conductive part and a fourth conductive part, which are arranged beside each other.

15. The key structure according to claim 14, wherein the third conductive part and the fourth conductive part are semicircular-arc parts and arranged in a staggered form.

16. The key structure according to claim 10, wherein the key structure further comprises a resilience element, wherein the resilience element is arranged between the elastic element and the keycap and provides an additional traveling distance.

17. The key structure according to claim 10, wherein the connecting element comprises a first frame and a second frame.

* * * * *